US006669503B2

(12) United States Patent
Hirose

(10) Patent No.: US 6,669,503 B2
(45) Date of Patent: Dec. 30, 2003

(54) CONNECTOR HAVING A FUNCTION OF RELIABLY CORRECTING THE POSITION OF AN OBJECT TO BE CONNECTED

(75) Inventor: Kumi Hirose, Utsunomiya (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 12 days.

(21) Appl. No.: 10/164,134

(22) Filed: Jun. 5, 2002

(65) Prior Publication Data

US 2002/0187674 A1 Dec. 12, 2002

(30) Foreign Application Priority Data

Jun. 7, 2001 (JP) ..... 2001-172764

(51) Int. Cl.[7] ..... H01R 9/07
(52) U.S. Cl. ..... 439/495; 495/260
(58) Field of Search ..... 439/495, 493, 439/492, 259, 260, 67, 630, 329, 341

(56) References Cited

U.S. PATENT DOCUMENTS 5,842,883 A * 12/1998 Igarashi et al. ..... 439/495
6,056,572 A * 5/2000 Matsumoto et al. ..... 439/260
6,224,418 B1 * 5/2001 Miura et al. ..... 439/495
6,293,818 B1 * 9/2001 Kim et al. ..... 439/495
6,352,442 B1 * 3/2002 Kudo ..... 439/260

FOREIGN PATENT DOCUMENTS

JP 7-19978 4/1995
JP 2000-299153 10/2000

* cited by examiner

*Primary Examiner*—Hien Vu
(74) *Attorney, Agent, or Firm*—Michael, Best & Friedrich LLC

(57) ABSTRACT

For connecting an object having protruding portions protruding reverse to each other in a first direction, a connector includes a housing for guiding the object to an inserted position in a second direction perpendicular to the first direction, a contact held by the housing, and an actuator movable in a predetermined direction with respect to the housing so as to bring the object into press contact with the contact. The housing has receiving portions for receiving the protruding portions, respectively. The actuator has cover portions to face the receiving portions and to cover the protruding portions, respectively, when the object is brought into press contact with the contact. The cover portions respectively having slant surfaces to be engaged with the protruding portions of the object, when the object is located at a position deviated from the inserted position, to force the object towards the inserted position following the movement of the actuator to bring the object into press contact with the contact.

7 Claims, 7 Drawing Sheets

CONNECTOR HAVING A FUNCTION OF RELIABLY CORRECTING THE POSITION OF AN OBJECT TO BE CONNECTED

BACKGROUND OF THE INVENTION

This invention relates to a connector for connecting an object such as a circuit board called a flexible printed circuit (FPC) and a cable called a flexible flat cable (FFC).

At first referring to FIGS. 1A to 1C, description will be made of a conventional technique (hereinafter referred to as a "first conventional technique") disclosed in Japanese Unexamined Patent Publication No. 2000-299153 (JP 2000-299153 A).

As illustrated in FIG. 1B, a connector 11 comprises a connector housing 12 attached to a printed wiring board by soldering or the like, a connector locking portion 13 having one end pivotably supported by the connector housing 12 and the other end rotatable in directions X and Y, and a pair of connector locking members 14 protruding from the other end of the connector locking portion 13 at opposite sides thereof. As illustrated in FIG. 1C, a FFC 16 comprises a cable body 17, a cable connecting portion 18 formed at an end of the cable body 17, and a cable locking protrusion 19 formed at a rear part of the cable connecting portion 18. The cable locking protrusion 19 has a trapezoidal shape as a whole with a pair of triangular portions protruding laterally outward from the cable body 17 at opposite sides thereof.

Description will be made of a method of connecting the connector 11 and the FFC 16.

At first, the connector locking portion 13 of the connector 11 is rotated in the direction X to be put into an opened state, as illustrated in FIG. 1B. Next, the cable connecting portion 18 of the FFC 16 is connected to a connection terminal formed between the connector housing 12 and the connector locking portion 13. It is noted here that the connector 11 and the FFC 16 is connected when the cable connecting portion 18 is completely inserted into the connector 11 to reach a possible innermost position. If the cable connecting portion 18 is not completely inserted into the connector 11 and does not reach the innermost position, i.e., if the cable connecting portion 18 is in a semi-inserted state, the connector 11 is not connected to the FFC 16.

Subsequently, the connector locking portion 13 is rotated in the direction Y to a closed state, as illustrated in FIG. 1A. As a consequence, the connector 11 and the FFC 16 are fixed and the connection therebetween is completed. At this time, if the cable connecting portion 18 is connected to the connection terminal, the connector locking portion 13 can be closed and the connector locking members 14 are engaged with a bottom edge of the cable locking protrusion 19 at opposite sides thereof. Therefore, even if the FFC 16 is applied with an unexpected force, the FFC 16 is not released from the connector 11. On the other hand, if the cable connecting portion 18 is not connected to the connection terminal, the connector locking members 14 are brought into contact with upper surfaces of the triangular portions at the opposite sides of the cable locking protrusion 19 when the connector locking portion 13 is rotated towards the closed state. Thus, in the semi-inserted state, the connector locking portion 13 can not be closed.

In the first conventional technique, however, it is impossible to correct the semi-inserted state into a completely-inserted state although the completely-inserted state can be confirmed. Furthermore, it is impossible to protect a forward end portion of the FFC 16 from an unexpected external force.

Next referring to FIG. 2, description will be made of another conventional technique (hereinafter referred to as a "second conventional technique") disclosed in Japanese Unexamined Utility Model Publication No.19978/1995 (JP 7-19978 U).

A connector 21 comprises a housing 22 and a locking member 23. The housing 22 is provided with an opening 22*a* and an internal cavity 22*b*. The housing 22 holds a plurality of contacts 24 having one ends protruding into the internal cavity 22*b* and the other ends protruding outward.

The locking member 23 has a forward end provided with a ridge portion 23*a* and a rear end provided with a pair of pressing portions 23*b* formed at opposite sides thereof to protrude outward in a widthwise direction.

An FPC 26 comprises a base film 26*a*, a plurality of lead wires 26*b* formed on the base film 26*a* and arranged in parallel to one another, a connecting end 26*c* formed at one end thereof, an overcoat layer 26*d* covering the lead wires 26*b* except the connecting end 26*c*, a reinforcing plate 26*e* adhered to a back surface of the base film 26*a* to reinforce the connecting end 26*c*, and a pair of widthwise protrusions 26*f* formed at opposite sides in the vicinity of the connecting end 26*c*.

Description will be made of a method of connecting the connector 21 and the FPC 26.

At first, the connecting end 26*c* of the FPC 26 is inserted into the internal cavity 22*b* until the widthwise protrusions 26*f* are brought into contact with the housing 22. Next, the locking member 23 is inserted into the internal cavity 22*b* of the housing 22 along a rear surface of the FPC 26. In this event, the ridge portion 23*a* of the locking member 23 brings the lead wires 26*b* into press contact with the one ends of the contacts 24 through the reinforcing plate 26*e* and the base film 26*a*. The pressing portions 23*b* of the locking portion 23 press the widthwise protrusions 26*f* of the FPC 26. As a consequence, the FPC 26 is forced into the housing 22 so that the FPC 26 is connected to the connector 21.

In the second conventional technique, however, it is impossible to protect a forward end portion of the FPC 26 from an unexpected external force although a semi-inserted state of the FPC 26 inserted into the connector 21 hardly occurs.

SUMMARY OF THE INVENTION

It is therefore an object of this invention to provide a connector capable of automatically correcting a semi-inserted state of an object to be connected and protecting a forward end portion of the object from an unexpected external force.

Other objects of the this invention will become clear as the description proceeds.

According to this invention, there is provided a connector adapted to be connected to an object having a pair of protruding portions protruding reverse to each other in a first direction. The connector comprises a housing for guiding the object to an inserted position in a second direction perpendicular to the first direction, a contact held by the housing, and an actuator movable in a predetermined direction with respect to the housing so as to bring the object into press contact with the contact. The housing has a pair of receiving portions for receiving the protruding portions, respectively. The actuator has a pair of cover portions to face the receiving portions and to cover the protruding portions, respectively, when the object is brought into press contact with the contact. The cover portions respectively have slant surfaces to be engaged with the protruding portions of the object, when the object is located at a position deviated from the inserted position, to force the object towards the inserted position following the movement of the actuator to bring the object into press contact with the contact.

DESCRIPTION OF PREFERRED EMBODIMENTS

Referring to FIGS. 3 to 7, description will be made of a connector according to one embodiment of this invention.

Figure 4:
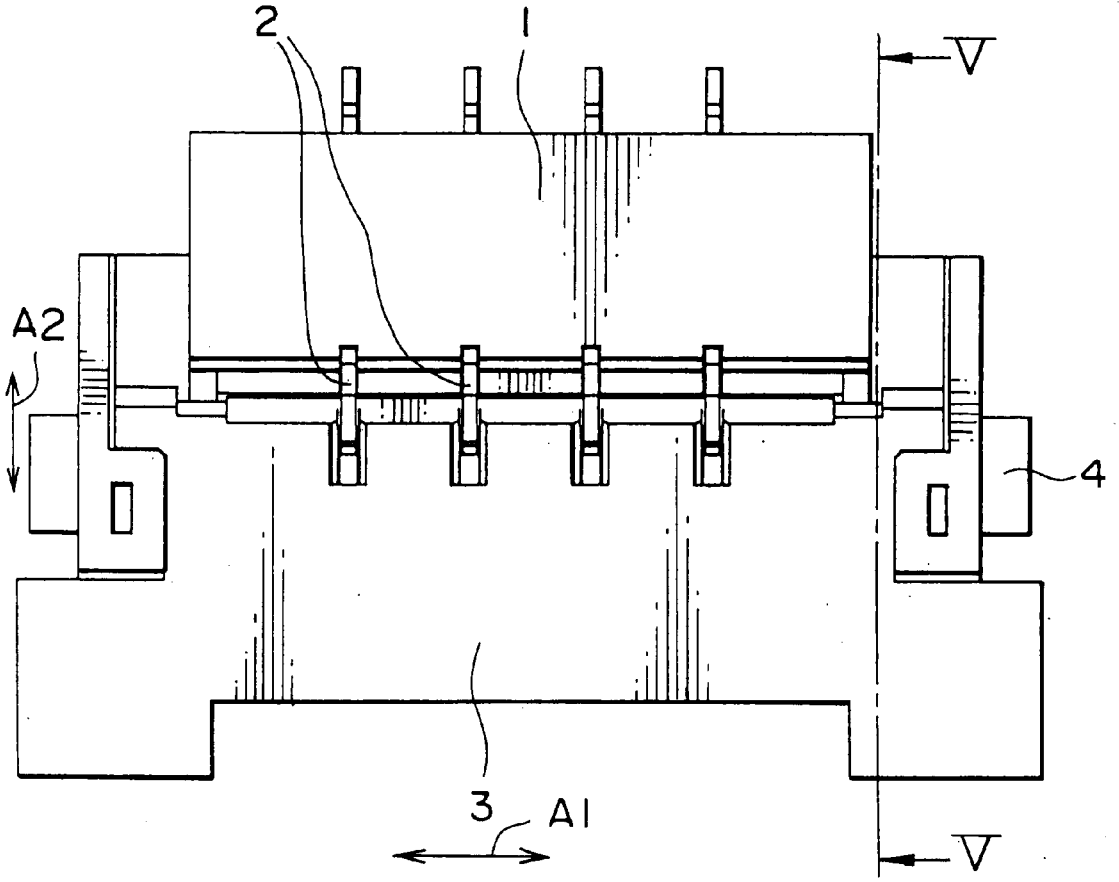
FIG. 4 is a plan view of the connector illustrated in FIG. 3.
Figure 5:
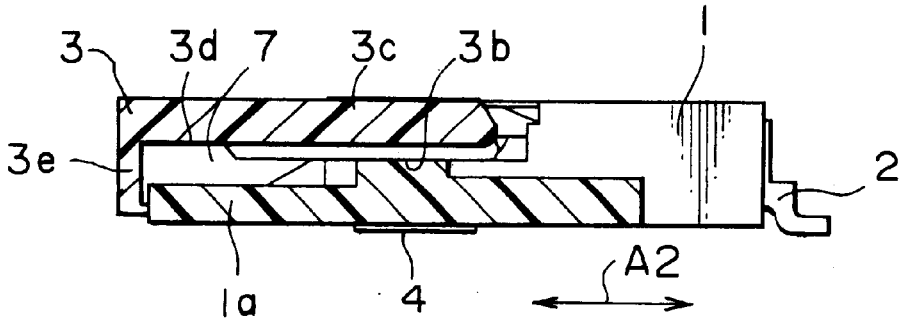
FIG. 5 is a sectional view taken along a line V—V in FIG. 4.
Figure 6:
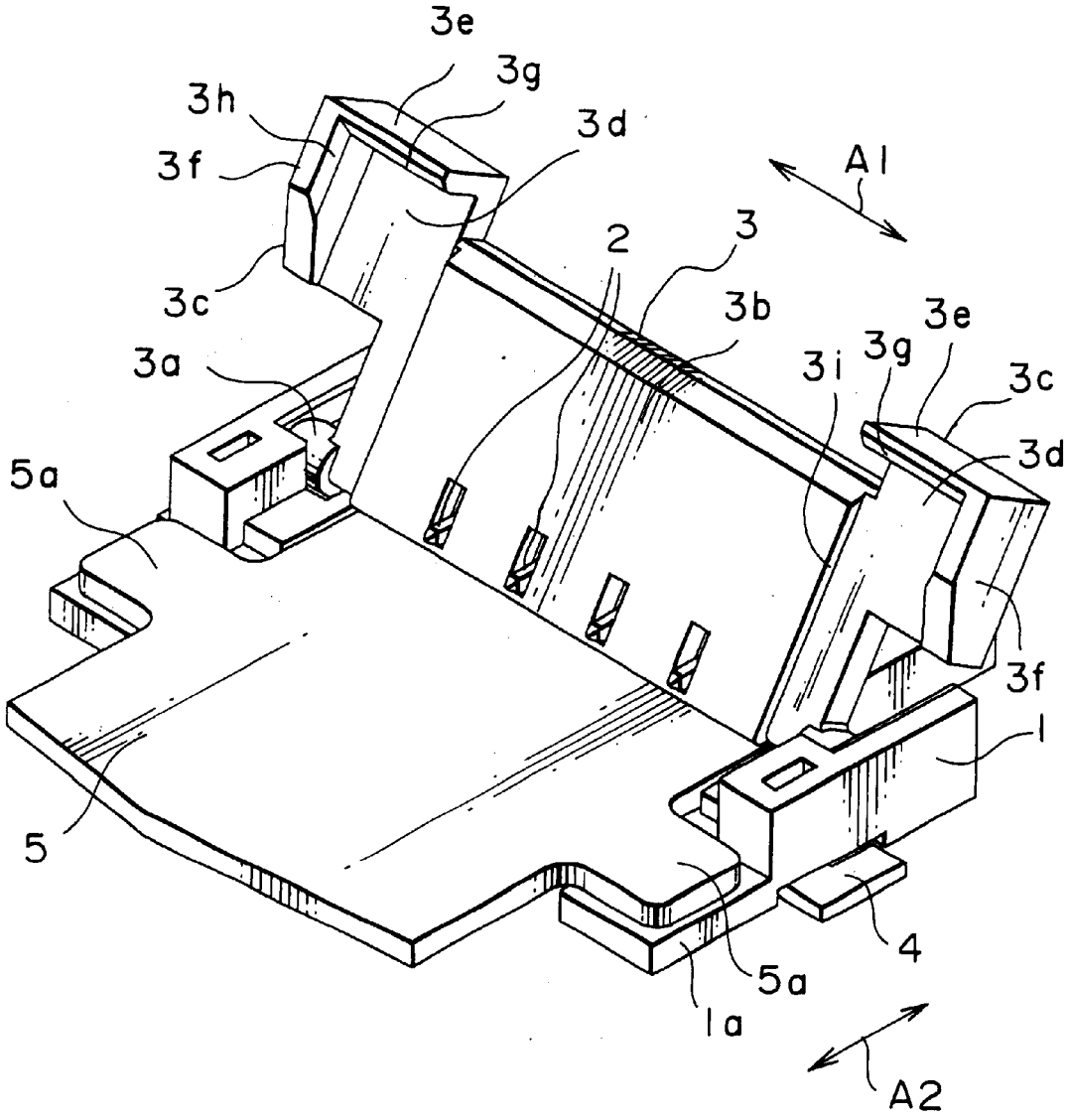
FIG. 6 is a perspective view of the connector in FIG. 3 together with a printed board.
Figure 7:
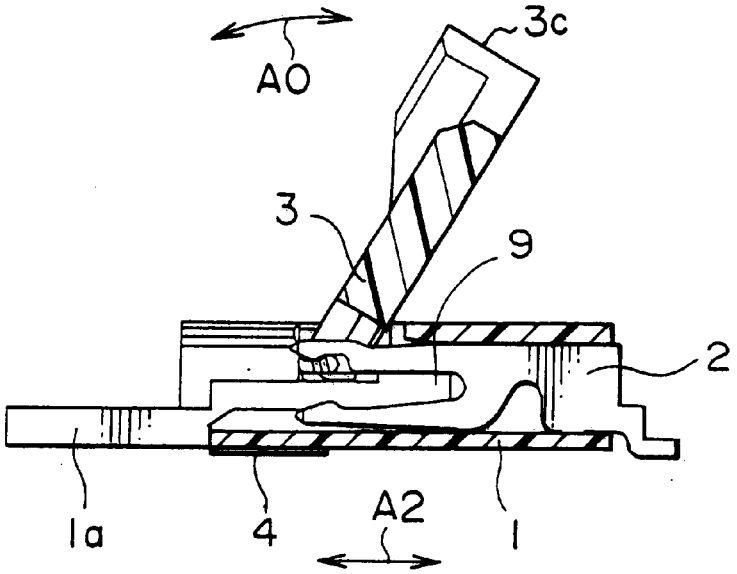
FIG. 7 is a sectional side view of the connector illustrated in FIG. 6.

The connector illustrated in FIGS. 3 to 7 comprises an insulator housing 1 and a plurality of conductive receptacle contacts 2 held by the housing 1 and arranged in a first direction A1 in a single array. The housing 1 is provided with an insulating actuator 3 which is rotatable between an opened position and a closed position. As illustrated in FIG. 6, the actuator 3 has a pair of axes 3*a* formed at opposite sides thereof to protrude outward in the first direction A1. The axes 3*a* are rotatably supported by bearings (not shown) formed at opposite sides of the housing 1, respectively, and serve as the center of rotation of the actuator 3. Thus, the actuator 3 is movable in a predetermined direction, i.e., a rotating direction A0 (FIG. 7). The housing 1 has a bottom surface provided with a pair of hold-downs 4 attached to a center area at opposite sides thereof.

Figure 8:
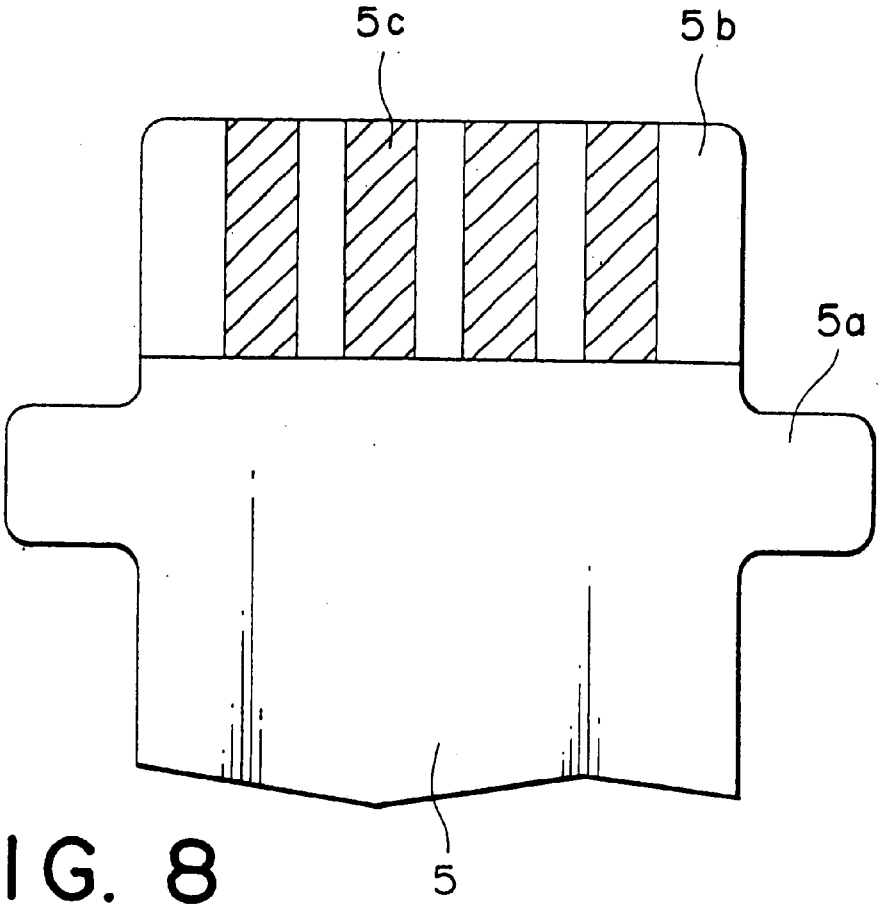
FIG. 8 is a plan view showing a characteristic part of the printed board used in FIGS. 6 and 7.

A flexible printed board 5 as an object to be connected is illustrated in FIG. 8. In the state illustrated in FIGS. 6 and 7 where the actuator 3 is opened, the flexible printed board 5 is guided along the housing 1 towards an inserted position in a second direction A2 perpendicular to the first direction A1. At the inserted position, a fitting portion 9 of each receptacle contact 2 is located. The flexible printed board 5 has an insert portion 5*b* provided with a plurality of contact points 5*c* formed at a plurality of positions on its surface. The flexible printed board 5 guided to the insert position is inserted into the fitting portion 9 of each of the receptacle contacts 2 so that the contact points 5*c* are brought into light contact with the receptacle contacts 2, respectively.

The flexible printed board 5 is provided with a pair of widthwise protrusions 5*a* formed at opposite sides thereof in the first direction A1. In order to receive lower surfaces of the widthwise protrusions 5*a*, the housing 1 has a pair of receiving portions 1*a* extending frontward from its bottom surface. Each of the widthwise protrusions 5*a* is substantially identical in shape with each of the receiving portions 1*a* but each receiving portion 1*a* is slightly greater in area than each widthwise protrusion 5*a*.

The actuator 3 has a pressing surface portion 3*b* formed at the center of its lower surface. The actuator 3 has a pair of cover portions 3*c* integrally formed at its opposite sides. Each of the cover portions 3*c* has a lower surface portion 3*d*, a first standing portion 3*e* perpendicularly protruding from one end face of the lower surface portion 3*d* to extend in a widthwise direction, and a second standing portion 3*f* perpendicularly protruding from another end face of the lower surface portion 3*d* to extend in a longitudinal direction and perpendicularly connected to the first standing portion 3*e*. The first standing portion 3*e* has a slant surface 3*g* formed at its inner edge. The slant surface 3*g* in inclined with respect to the rotating direction A0 and the second direction A2. The second standing portion 3*f* is provided with a tapered surface 3*h* formed at its inner edge. The tapered surface 3*h* is inclined with respect to the rotating direction A0 and the first direction A1. Between the pressing surface portion 3*b* and each of the lower surface portions 3*d* at opposite sides thereof, a small step 3*i* is formed.

Figure 1A:
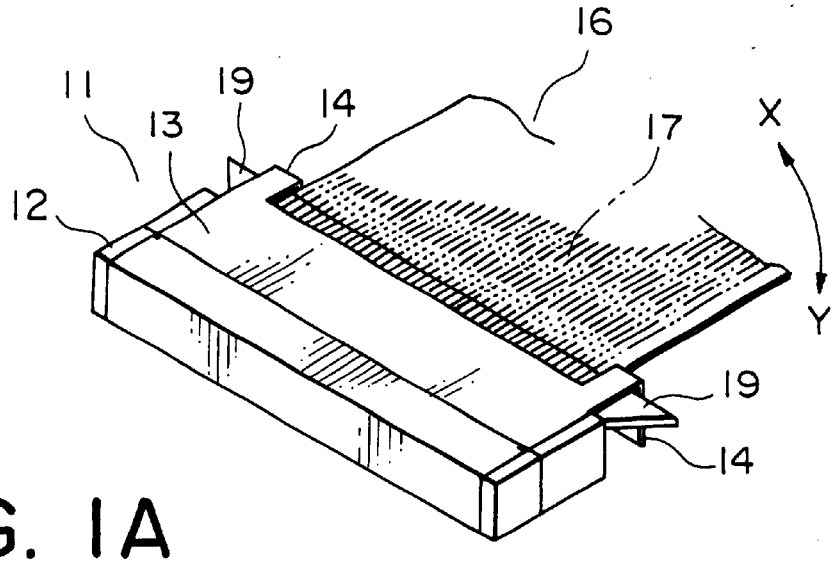
FIG. 1A PRIOR ART
FIG. 1A is a perspective view of a first conventional connector together with a cable connected thereto.
Figure 1B:
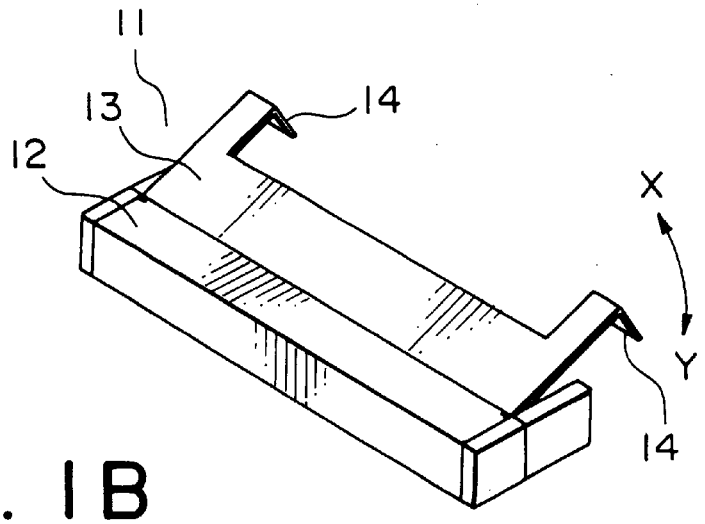
FIG. 1B PRIOR ART
FIG. 1B is a perspective view of the connector in FIG. 1A when the cable is not connected thereto.
Figure 1C:
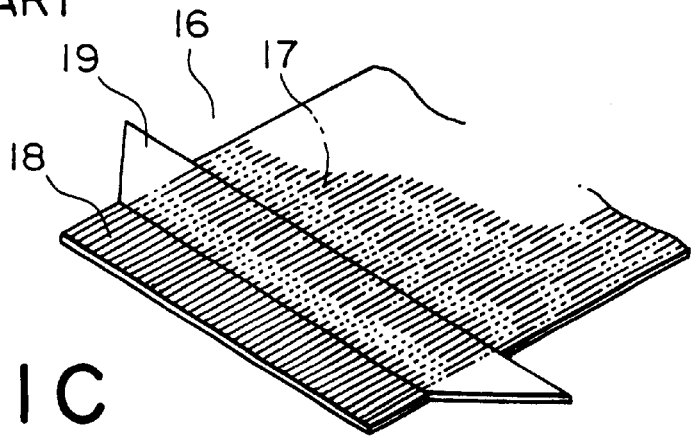
FIG. 1C PRIOR ART
FIG. 1C is a perspective view showing a characteristic part of the cable illustrated in FIG. 1A.
Figure 2:
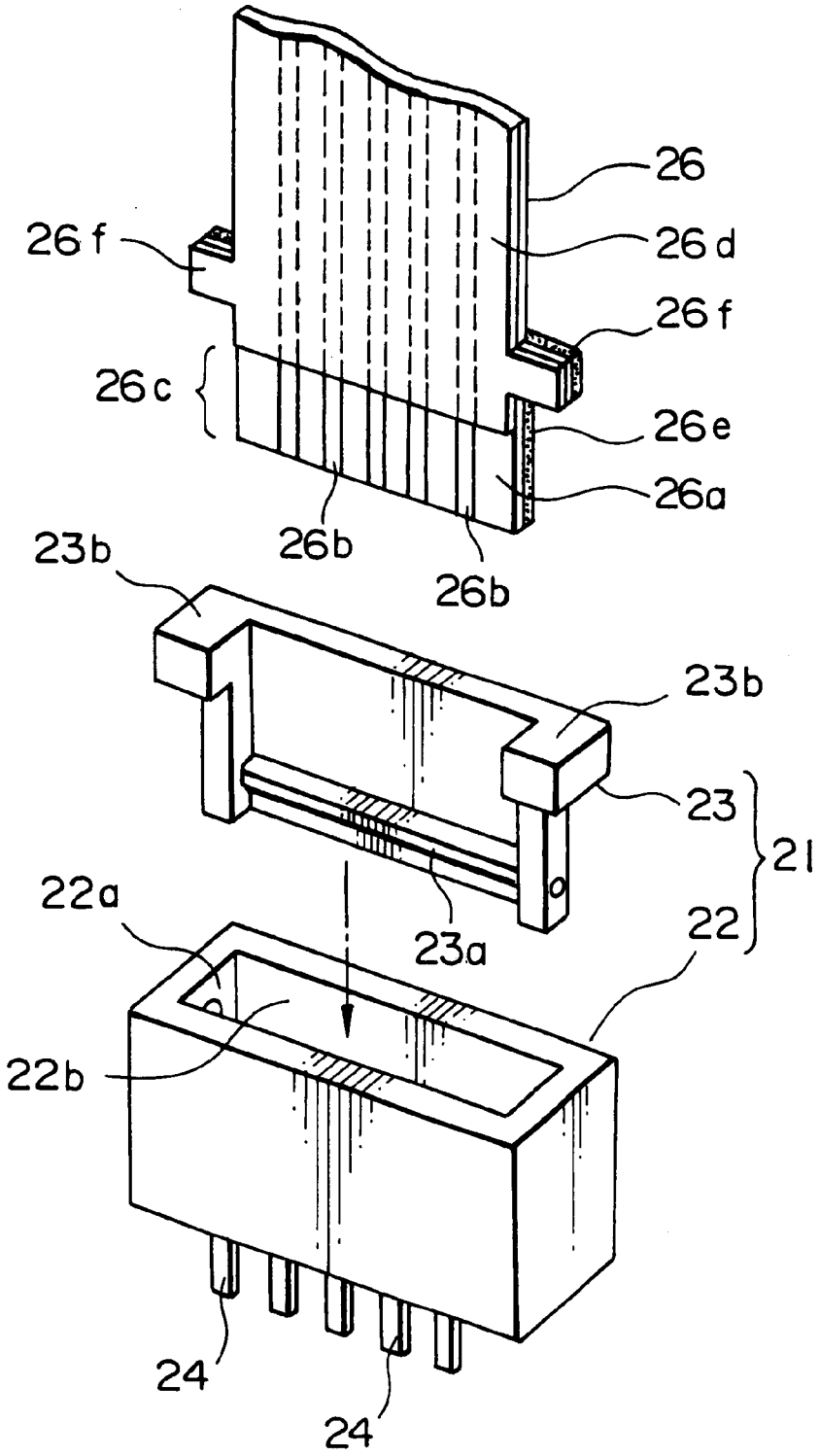
FIG. 2 PRIOR ART
FIG. 2 is an exploded perspective view of a second conventional connector together with a printed board.
Figure 3:
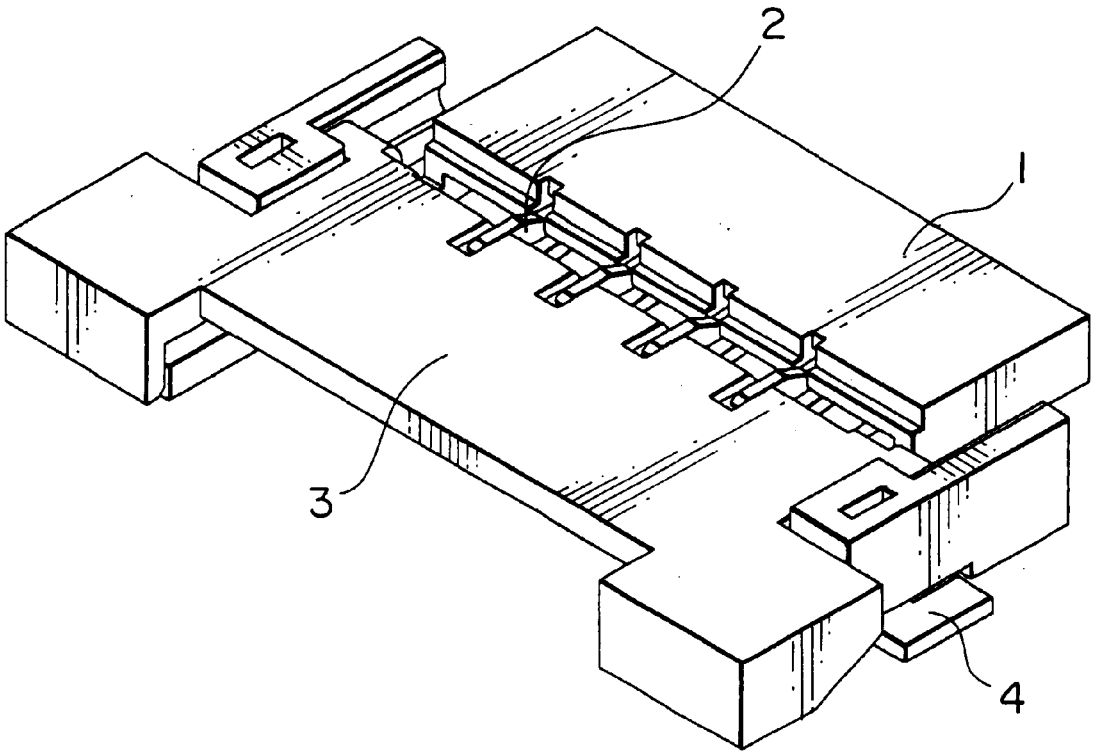
FIG. 3 is a perspective view of a connector according to one embodiment of this invention.

After the flexible printed board 5 is set in the housing 1, the actuator 3 is rotated from the opened position illustrated in FIGS. 6 and 7 to the closed position illustrated in FIGS. 3 to 5 with respect to the axes 3*a* as the center of rotation. In this event, the cover portions 3*c* cover the widthwise protrusions 5*a* of the flexible printed board 5 and the receiving portions 1*a* of the housing 1 to protect a forward end portion of the flexible printed board 5 from an unexpected external force. Simultaneously, the pressing surface portion 3*b* presses an upper surface of the flexible printed board 5. If the flexible printed board 5 is in a semi-inserted state with respect to the housing 1 (not completely inserted into the housing 1), i.e., if the flexible printed board 5 is offset or displaced or deviated from the inserted position, the slant surfaces 3*g* press the widthwise protrusions 5*a* in the second direction A2 towards the inserted position so that the flexible printed board 5 is moved to the inserted position in a completely inserted state. Thus, the position of the flexible printed board 5 is automatically corrected in the second direction A2.

Furthermore, in case where the flexible printed board 5 is located at a position displaced or deviated leftward or rightward from a normal position with respect to the housing 1, one of the tapered surfaces 3*h* forces one of the widthwise protrusions 5*a* rightward or leftward. Therefore, the flexible printed board 5 is moved to the normal position in the first direction A1. Thus, the position of the flexible printed board 5 is automatically corrected in the first direction A1.

The connector has a cavity 7 surrounded by the lower surface portions 3*d* of the cover portions 3*c*, the first standing portions 3*e*, the second standing portions 3*f*, and the receiving portions 1*a* of the housing 1.

Next referring to FIGS. 9 and 10, description will be made of a connector according to another embodiment of this invention. Similar parts to those of the connector illustrated in FIGS. 3 to 7 are designated by like reference numerals.

Figure 9:
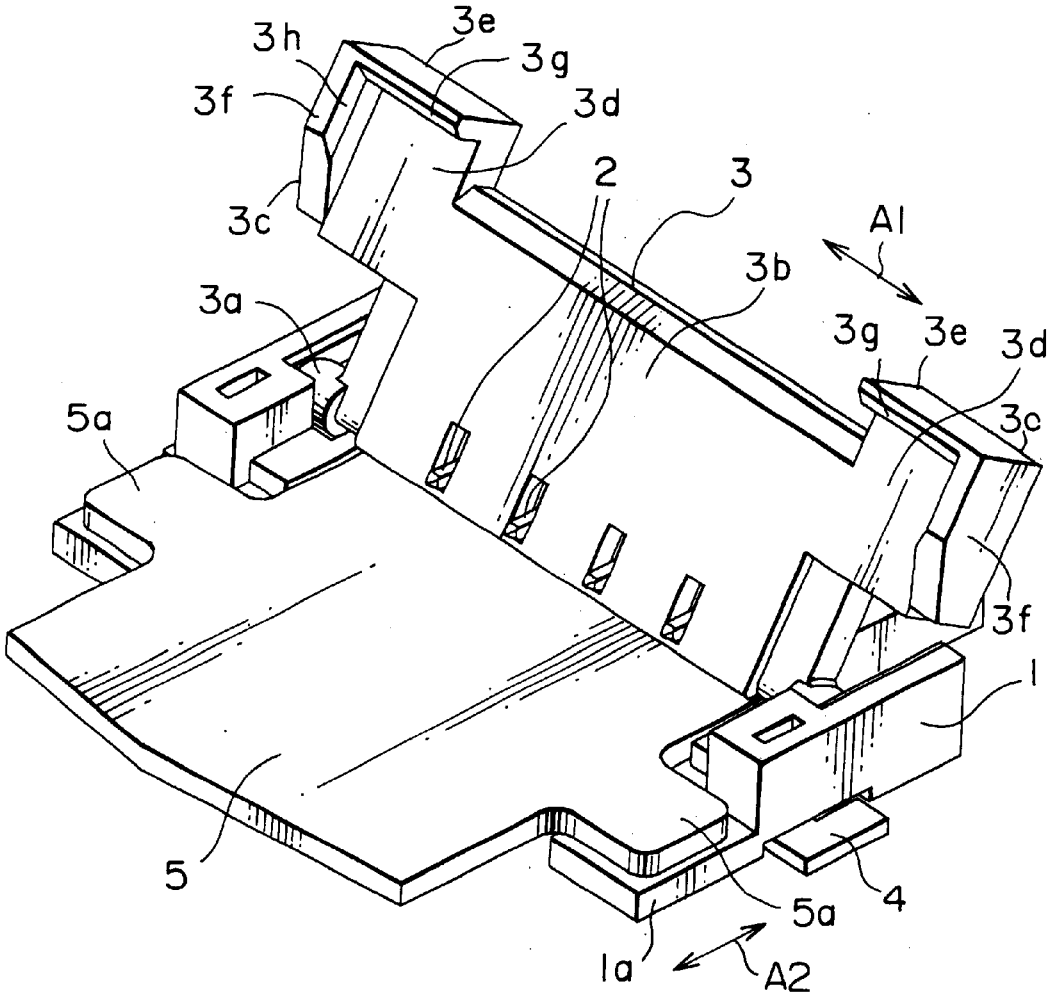
FIG. 9 is a perspective view of a connector according to another embodiment of this invention together with a printed board.
Figure 10:
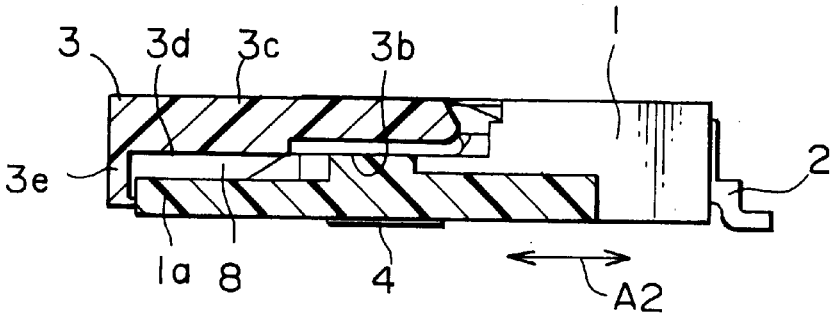
FIG. 10 is a sectional view similar to FIG. 5 but showing the connector illustrated in FIG. 9.

The connector illustrated in FIGS. 9 and 10, no corresponding part equivalent to the step 3*i* in FIG. 6 is formed between the pressing surface portion 3*b* and each of the lower surface portions 3*d*. The connector of this embodiment has a cavity 8 surrounded by the lower surface portions 3*d* of the cover portions 3*c*, the first standing portions 3*e*, and the second standing portions 3*f*, and the receiving portions 1*a* of the housing 1. The cavity 8 is smaller in depth in the vertical direction than the cavity 7 in FIG. 5.

Each of the connectors described in conjunction with FIGS. 3 to 10 will be provided with following advantages.

1. In case where the object inserted into the housing is in a semi-inserted state, the slant surfaces of the actuator being operated press the widthwise protrusions of the object in an inserting direction to move the object towards the inserted position. In case where the object is located at a position deviated leftward or rightward from the normal position in the housing, one of the tapered surfaces forces one of the widthwise protrusions of the object rightward or leftward to move the object to the normal position. Thus, the position of the object is automatically corrected to the normal position.

2. Under the widthwise protrusions of the object, the receiving portions of the housing are located. Upper surfaces of the widthwise protrusions are protected by the cover portions of the actuator. Therefore, even if the object is applied with an unexpected force acting in the vertical direction, the object is reliably held.

3. The widthwise protrusions of the object are formed at positions such that the protrusions are not inserted into the interior of the housing. Therefore, the connector is not increased in size in the widthwise direction (perpendicular to the inserting direction of the object). Furthermore, if each of the widthwise protrusions of the object is substantially identical in shape to each of the receiving portions, it is possible for an operator to confirm the position of the object with respect to the housing.

While the present invention has thus far been described in connection with a few embodiments thereof, it will readily be possible for those skilled in the art to put this invention into practice in various other manners. For example, the actuator may be held to be linearly movable. The object may be a different type of printed board or a flexible flat cable.

What is claimed is:

1. A connector adapted to be connected to an object having a pair of protruding portions protruding reverse to each other in a first direction, said connector comprising:

a housing for guiding said object to an inserted position in a second direction perpendicular to said first direction;

a contact held by said housing; and an actuator movable in a predetermined direction with respect to said housing so as to bring said object into press contact with said contact, said housing having a pair of receiving portions for receiving said protruding portions, respectively, said actuator having a pair of cover portions to face said receiving portions and to cover said protruding portions, respectively, when said object is brought into press contact with said contact, said cover portions respectively having slant surfaces to be engaged with edges of said protruding portions of said object, when said object is located at a position deviated from said inserted position, to force said object towards said inserted position following the movement of said actuator to bring said object into press contact with said contact, wherein said actuator is held by said housing to be rotatable with respect to said housing.

2. The connector according to claim 1, wherein each of said slant surfaces is inclined with respect to said second direction and said predetermined direction.

3. The connector according to claim 1, wherein said cover portions have first standing portions to face said protruding portions in said second direction, respectively, when said cover portions cover said protruding portions, said slant surface being formed in said first standing portions, respectively.

4. The connector according to claim 1, wherein a combination of said cover portions have a tapered surface which is formed so that, when said object is located at a position deviated from a normal position in said first direction, said tapered surface is engaged with a corresponding one of said protruding portions to force said object in said first direction towards said normal position following the movement of said actuator to bring said object into press contact with said contact.

5. The connector according to claim 1, wherein said tapered surface is inclined with respect to said first and said predetermined directions.

6. The connector according to claim 4, wherein said cover portions have second standing portions to face said protruding portions in said first direction, respectively, when said cover portions cover said protruding portions, said tapered surface being formed in a combination of said second standing portions.

7. The connector according to claim 1, wherein said actuator has a rotation center axis extending in said first direction.

* * * * *